US012162664B2

(12) United States Patent
Yavets-Chen et al.

(10) Patent No.: US 12,162,664 B2
(45) Date of Patent: Dec. 10, 2024

(54) BLISTER PACK AND BLISTER PACK HOLDER

(71) Applicant: PICODYA TECHNOLOGIES LTD., Rehovot (IL)

(72) Inventors: Yehuda Yavets-Chen, Kfar Vitkin (IL); Tzvika Barkai, D.N. Negev (IL)

(73) Assignee: Picodya Technologies Ltd., Rehovot (IL)

( * ) Notice: Subject to any disclaimer, the term of this patent is extended or adjusted under 35 U.S.C. 154(b) by 238 days.

(21) Appl. No.: 17/792,140

(22) PCT Filed: Jan. 13, 2021

(86) PCT No.: PCT/IL2021/050043

§ 371 (c)(1),
(2) Date: Jul. 11, 2022

(87) PCT Pub. No.: WO2021/144797

PCT Pub. Date: Jul. 22, 2021

(65) Prior Publication Data

US 2023/0051725 A1 Feb. 16, 2023

Related U.S. Application Data

(60) Provisional application No. 62/961,725, filed on Jan. 16, 2020.

(51) Int. Cl.
*B65D 75/32* (2006.01)
*B65D 83/00* (2006.01)

(52) U.S. Cl.
CPC ..... *B65D 75/326* (2013.01); *B65D 83/0055* (2013.01); *B65D 2575/3227* (2013.01)

(58) Field of Classification Search
CPC ..... B65D 75/326; B65D 93/0055; B65D 2575/3227
See application file for complete search history.

(56) References Cited

U.S. PATENT DOCUMENTS

2002/0166792 A1* 11/2002 Filion ..... B65D 75/367 206/532
2003/0111380 A1* 6/2003 Taneja ..... B65D 75/327 206/534.1

(Continued)

FOREIGN PATENT DOCUMENTS

CA 2436335 1/2005
CN 102849336 1/2013

(Continued)

OTHER PUBLICATIONS

International Search Report for PCT application No. PCT/IL2021/050043 dated Apr. 26, 2022.

*Primary Examiner* — Paul R Durand
*Assistant Examiner* — Michael J. Melaragno
(74) *Attorney, Agent, or Firm* — PEARL COHEN ZEDEK LATZER BARATZ LLP

(57) ABSTRACT

A blister pack may include a containing body with an opening; and a lid sealed over the opening and provided with a weakening pattern, wherein a width of the lid at the weakening pattern is thinner that a width of the lid elsewhere, and wherein the lid is configured to burst at the weakening pattern when the blister pack is subjected to pressure, so as to allow liquid content inside the containing body to be discharged out of the blister pack through the burst weakening pattern. A blister pack holder is also disclosed.

7 Claims, 13 Drawing Sheets

(56) References Cited

U.S. PATENT DOCUMENTS

| | | | | |
|---|---|---|---|---|
| 2005/0284789 | A1* | 12/2005 | Carespodi | B32B 7/12 428/35.8 |
| 2008/0135441 | A1* | 6/2008 | Meliniotis | A61M 15/0045 53/133.8 |
| 2009/0145800 | A1 | 6/2009 | Bowers et al. | |
| 2011/0262589 | A1* | 10/2011 | Safarik | B32B 3/266 426/119 |
| 2012/0107811 | A1* | 5/2012 | Kelso | B65B 47/04 435/287.2 |
| 2013/0306511 | A1 | 11/2013 | Branyon et al. | |
| 2013/0327672 | A1* | 12/2013 | Kurowski | B01L 3/52 206/462 |
| 2018/0015474 | A1* | 1/2018 | Arlett | B01L 3/527 |
| 2023/0051725 | A1* | 2/2023 | Yavets-Chen | B01L 9/06 |

FOREIGN PATENT DOCUMENTS

| | | | | |
|---|---|---|---|---|
| CN | 206965753 | | 2/2018 | |
| JP | 2005-8258 | | 1/2005 | |
| JP | 2015-536883 | | 12/2015 | |
| WO | WO2009/143234 | | 11/2009 | |
| WO | WO-2021144797 | A1 * | 7/2021 | A61J 1/035 |

* cited by examiner

BLISTER PACK AND BLISTER PACK HOLDER

CROSS-REFERENCE TO RELATED APPLICATIONS

This application is a US National Phase Application of PCT International Patent Application No. PCT/IL2021/050043 International Filing Date Jan. 13, 2021, claiming the benefit of U.S. Provisional Patent Application No. 62/961,725 filed Jan. 16, 2020, which is hereby incorporated by reference.

FIELD OF THE INVENTION

The present invention relates to liquid retaining and liquid management. More particularly, the present invention relates to blister packs and blister pack holders.

BACKGROUND OF THE INVENTION

Blister pack generally refers to various types of pre-formed plastic packaging used for storing small items, such as small consumer goods, foods and pharmaceuticals.

The primary component of a blister pack is a containing body usually formed of a formable web, e.g., thermoplastic, which is filled and then covered and sealed by a lid, typically an aluminum foil or plastic film, sealed (e.g., welded) over the opening of the containing body of the blister pack.

Blister packs are designed to guard their content from contamination, humidity, for extended periods of time, to allow long shelf life and extended durability.

It may be desired to use blister packs for storing reagent fluids and liquids for use in biological or chemical analysis or testing. It may also be desired to provide blister packs with predetermined bursting location, and to provide blister pack holders and holding systems configured to store one or a plurality of blister packs and empty the contents of said one or a plurality of blister packs in a controlled manner, where desired.

SUMMARY

There is thus provided, in accordance with some embodiments of the invention, a blister pack comprising: a containing body with an opening; and a lid sealed over the opening and provided with a weakening pattern, wherein a width of the lid at the weakening pattern is thinner that a width of the lid elsewhere, and wherein the lid is configured to burst at the weakening pattern when the blister pack is subjected to pressure, so as to allow liquid content inside the containing body to be discharged out of the blister pack through the burst weakening pattern.

According to some embodiments of the present invention, the width of the lid at the weakening pattern is in the range of 30 to 70 percent of the width of the lid elsewhere.

According to some embodiments of the present invention, the width of the lid is in the range of 50 to 200 microns.

According to some embodiments of the present invention, the containing body has a brim surrounding the opening.

According to some embodiments of the present invention, at least some of the weakening pattern is located away from an area of the lid which is in contact with the containing body.

According to some embodiments of the present invention, a shape of the weakening pattern is selected from the group consisting of one or a plurality of lines, a cross, Y-shape, and two or more separate patterns.

According to some embodiments of the present invention, the weakening pattern crosses across the lid from an edge of the lid to another edge of the lid.

According to some embodiments of the present invention, the containing body has a substantially cylindrical form.

According to some embodiments of the present invention, the containing body has a truncated cone form.

According to some embodiments of the present invention, the blister pack further includes a sleeve accommodating the containing body.

According to some embodiments of the present invention, the sleeve has a cylindrical outer surface.

According to some embodiments of the present invention, the sleeve has a cylindrical inner surface.

According to some embodiments of the present invention, the sleeve has a tapered inner surface.

According to some embodiments of the present invention, there is provided a blister pack holder comprising: a block with one or a plurality of bores extending through the block, each bore configured to accommodate a blister pack of one or a plurality of blister packs, the blister pack comprising a containing body with an opening; and a lid sealed over the opening; and one of a plurality of pressure applicators, each of said one of a plurality of pressure applicators applying pressure when actuated on a blister pack of said one of a plurality of blister packs to cause bursting of the lid of that blister pack and dispensing of liquid from that blister pack through an opening of that bore.

According to some embodiments of the present invention, each of said one or a plurality of bores has a cylindrical form.

According to some embodiments of the present invention, each of said one or a plurality of bores comprises a first opening at a first end of the bore and a second opening at a second end of the bore that is opposite to the first end.

According to some embodiments of the present invention, the second opening of the bore comprises a supporting flange, for supporting that blister pack.

According to some embodiments of the present invention, the supporting flange is configured to support a brim of that blister pack.

According to some embodiments of the present invention, the supporting flange comprises a plurality of voids.

According to some embodiments of the present invention, the blister pack further includes said one or a plurality of blister packs, and the lid includes a weakening pattern, wherein a width of the lid at the weakening pattern is thinner that a width of the lid elsewhere, and wherein the lid is configured to burst at the weakening pattern when the blister pack is subjected to pressure, so as to allow liquid content inside the containing body to be discharged out of the blister pack through the burst weakening pattern.

According to some embodiments of the present invention, each of said one or a plurality of blister packs is inserted into a confining cell, which when pushed into a bore of said one or a plurality of bores causes that blister pack to burst.

According to some embodiments of the present invention, the blister pack holder further includes said one or a plurality of blister packs, and the confining cell comprises two opposite walls which when inserted into the bore squeeze the blister pack to cause the blister pack to burst.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1A:
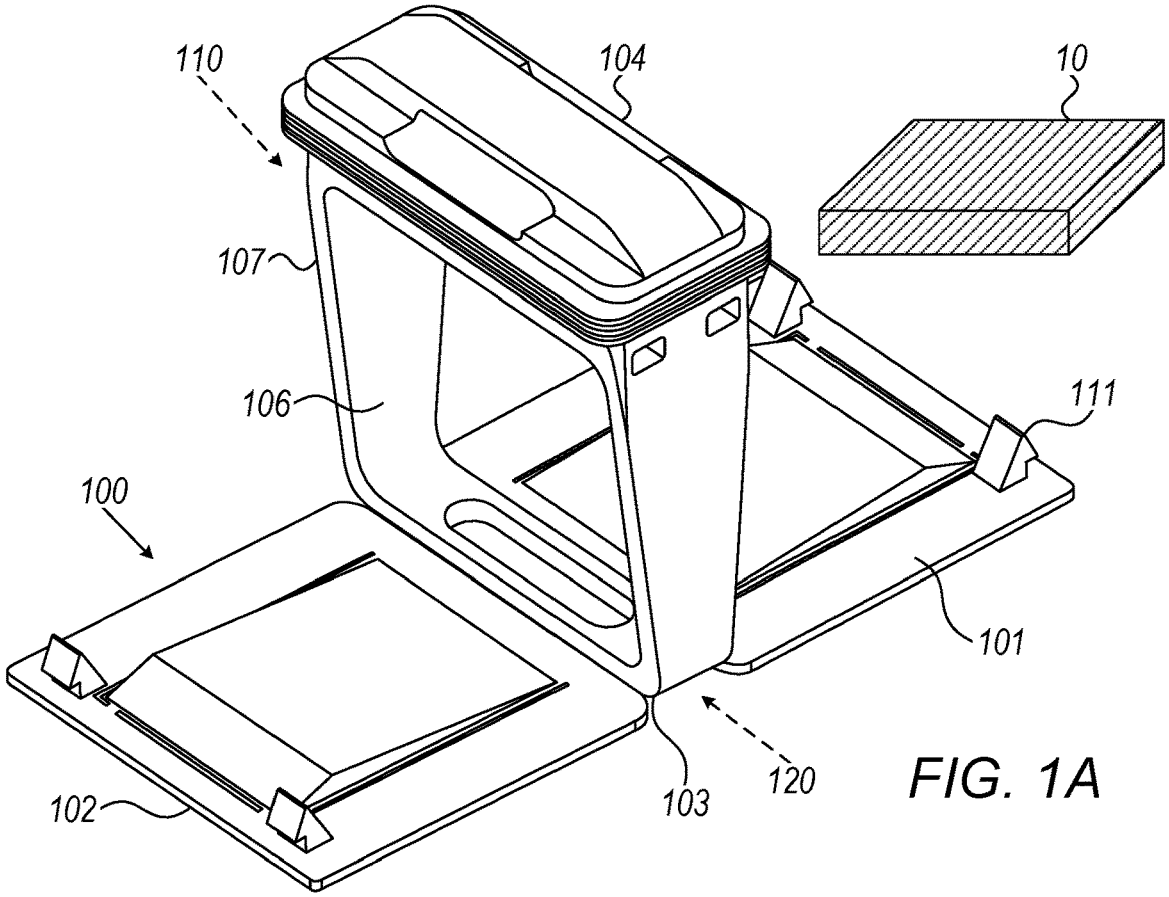
FIG. 1A shows a confining cell in an open state for accommodating a blister pack, according to some embodiments of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF EMBODIMENTS OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Although embodiments of the invention are not limited in this regard, discussions utilizing terms such as, for example, "processing," "computing," "calculating," "determining," "establishing", "analyzing", "checking", or the like, may refer to operation(s) and/or process(es) of a computer, a computing platform, a computing system, or other electronic computing device, that manipulates and/or transforms data represented as physical (e.g., electronic) quantities within the computer's registers and/or memories into other data similarly represented as physical quantities within the computer's registers and/or memories or other information non-transitory storage medium that may store instructions to perform operations and/or processes. Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. The term set when used herein may include one or more items. Unless explicitly stated, the method embodiments described herein are not constrained to a particular order or sequence. Additionally, some of the described method embodiments or elements thereof can occur or be performed simultaneously, at the same point in time, or concurrently.

According to some embodiments, systems and methods are provided for holding at least one blister pack filled with a fluid (e.g., filled with a reagent, reactant, solvent, catalyst, substrate, and/or any other substance that is used for reacting or otherwise brought in contact with sample liquid, or any other liquid to be tested—all of which and other such substances are hereinafter referred to as "reagent").

Figure 1B:
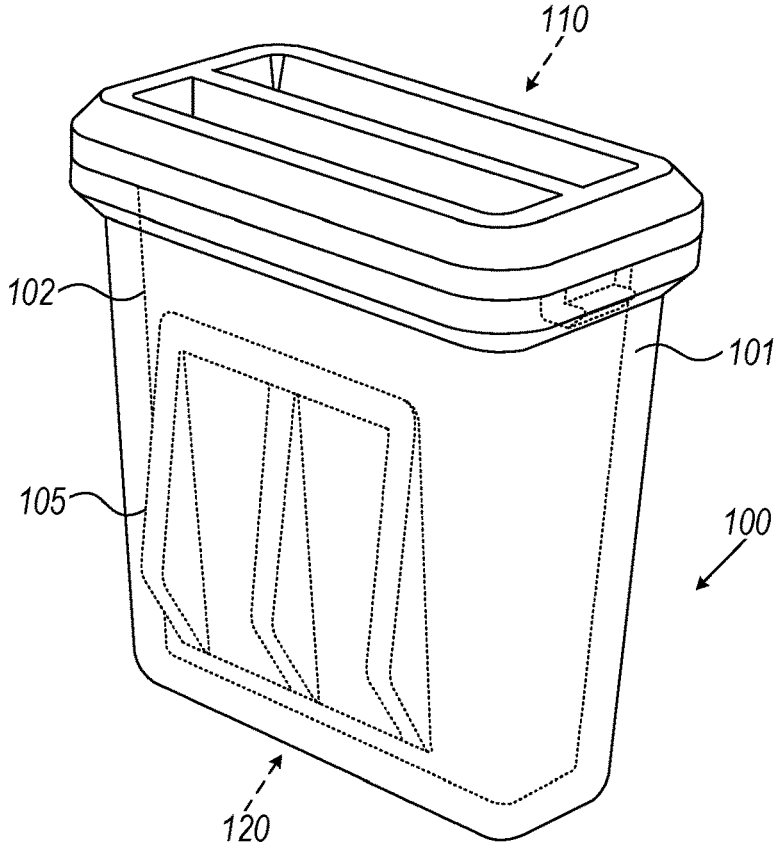
FIG. 1B shows the confining cell of FIG. 1A in a closed state, according to some embodiments of the invention.

Reference is made to FIGS. 1A and 1B, which schematically illustrate a cell 100 in an open state and a closed state, respectively, according to some embodiments of the invention. Cell 100 may be configured to accommodate a blister pack 10, when the cell 100 is in a closed state (as shown in FIG. 1B).

In some embodiments, the cell 100 may include a first wall 101, and a second wall 102 pivotally connected to the first wall 101 such that the walls 101, 102 of the cell 100 may rotate between an open state (as shown in FIG. 1A) and a closed state (as shown in FIG. 1B).

In some embodiments, each wall may rotate about an axis separately of the other wall, such that the cell 100 may include more than one pivot 103. For example, the cell 100 may include a housing and/or casing 107 onto which the walls 101, 102 may attach by rotating about the one or more pivot 103.

For example, blister pack 10 may initially be placed (e.g., manually) within an enclosure defined between the two walls such that cell 100 accommodates the blister pack 10, when in a closed state (as shown in FIG. 1B) by pivotally rotating the first wall 101 towards the second wall 102.

In some embodiments, the first wall 101 and the second wall 102 may both be pivotally rotated toward each other and/or rotated toward the housing 107 to hold the blister pack 10 within.

Once the blister pack 10 is accommodated within cell 100 (e.g., in a closed state as shown in FIG. 1B), cell 100 may be handled (e.g., carried around, displaced, handed over) securely, avoiding inadvertent perforation or tearing of the blister pack and spilling of its content.

In some embodiments, cell 100 may include an elastic material (e.g., plastic) in order to allow bursting of the blister pack 10 held within the cell 100 when sufficient force is applied thereto. For example, at least a portion of one wall may include elastic material such that the fluid filled blister pack 10 may burst when force is applied on that elastic portion since the blister pack 10 may also be elastic to allow squeezing and/or bursting for the fluid to flow out. Thus, the applied force on the cell 100 may be accordingly transferred to the blister pack 10 and cause the fluid within to flow out. In another example, at least one wall 101, 102 may be entirely elastic, such that force may be applied to every portion of that wall in order to burst the blister pack 10 within the cell 100. Additional bursting mechanisms, to cause the fluid within the blister pack 10 to flow, are described hereinafter.

In some embodiments, the cell 100 may include at least one protrusion 105 on at least one of: the first wall 101 and the second wall 102. The at least one protrusion 105 may be abut a cell holder in order to keep the cell 100 within the cell holder, as further described hereinafter. For example, the at least one protrusion 105 may have a sloping shape that may fit a corresponding shape in the cell holder.

In some embodiments, the at least one protrusion 105 may be elastic. Thus, a force applied on at least one of: the first wall 101 and the second wall 102 may accordingly push the at least one protrusion 105, for instance push the at least one protrusion 105 inward towards the blister pack 10 accommodated within the cell 100.

For example, when the cell 100 is inserted into a cell holder, as further described hereinafter, the engagement of the at least one protrusion 105 with the cell holder may cause a friction force to be applied onto the at least one protrusion 105. Thus, the at least one protrusion 105 may be accordingly pushed wards the blister pack 10 accommodated within the cell 100.

In some embodiments, the cell 100 may at least partially accommodate the blister pack 10 within a void or cavity 106, for instance the cavity 106 may be in the first wall 101 or in the second wall 102. In some embodiments, the cavity 106 may be within the housing 107.

In some embodiments, the second wall 102 may be configured to correspond in shape to the first wall 101, and be configured to be pivotally attached (e.g., rotated manually) to the first wall 101 for holding a blister pack 10 in a void within the first wall 101 and the second wall 102.

The shape of the second wall 102 may be configured to correspond in shape to the first wall 101 such that the fluid content of the blister pack 10 (e.g., a reagent for a particular sample of a patient), after its squeezed out or otherwise dispensed from the blister pack 10, remains within the cell 100 while cell 100 is in a closed state (e.g., as shown in FIG. 1B). In some embodiments, the cell 100 may be configured to allow the fluid content of the blister pack 10 to flow out of the cell 100 via a dedicated outlet (e.g., an aperture, a conduit, etc.), as further described hereinafter.

According some embodiments, the cell 100 may include a cap 104 configured to cover the cell 100 at a first side 110 (indicated with a dashed arrow) when the cell 100 is in a closed state (as shown in FIG. 1B), such that the cap 104 may prevent any fluid flow through the first side 110 (e.g., indicating the side through which the blister pack 10 is inserted). For example, the cap 104 may be a portion fixedly attached to at least one of the first wall 101, the second wall 102, and the housing 107. In some embodiments, the cap 104 may prevent the blister pack 10 from leaving the cell 100 when the cell 100 is in a closed state (e.g., as shown in FIG. 1B).

According some embodiments, at least one of the first wall 101 and the second wall 102 may include one or more projections 111 configured to engage the blister pack 10 when accommodated within the cell 100. For example, in a closed state of the cell 100 (e.g., as shown in FIG. 1B), the one or more projections 111 may abut or push the blister pack 10 to a desired position within the cell 100. In another example, the one or more projections 111 may prevent the blister pack 10 from moving within the cell 100.

In some embodiments, when fluid from the blister pack 10, accommodated within the cell 100, removed from the blister pack 10 due to squeezing and/or bursting, the fluid from the blister pack 10 may be gathered at a second side 120 (indicated with a dashed arrow), as further described hereinafter. The first side 110 may be opposite to the second side 120 (e.g., indicating the side through which the fluid is extracted).

According some embodiments, a blister pack holding system may hold one or more cells 100, for instance with each cell 100 accommodating a blister pack 10 with different content (e.g., a different reagent for different blister packs 10), such that analysis and/or diagnosis may be carried out simultaneously for all of the blister packs 10 in the blister pack holding system.

For example, the blister packs 10 may include reagents for samples from a plurality of patients to be analyzed with a single test. In another example, the blister packs 10 may include reagent for samples from a single patient where all blister packs 10 may be analyzed with different test by the dedicated analysis system.

Figure 1C:
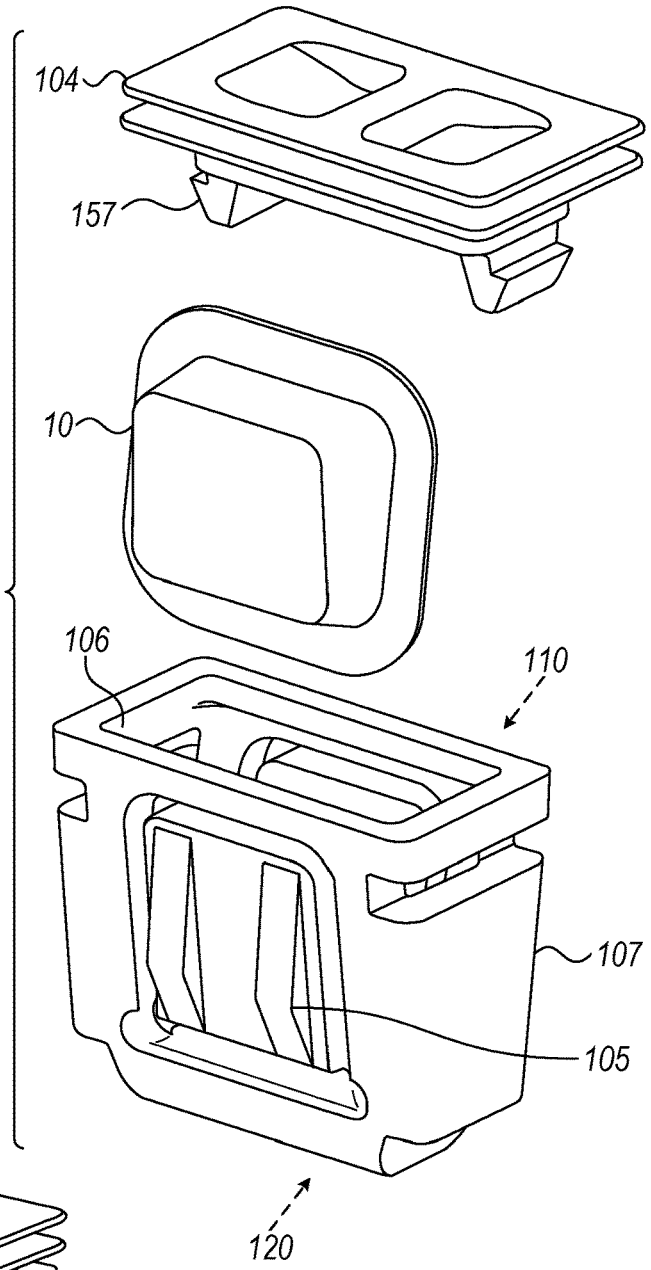
FIG. 1C shows a different configuration of the confining cell in an open state, according to some embodiments of the invention.
Figure 1D:
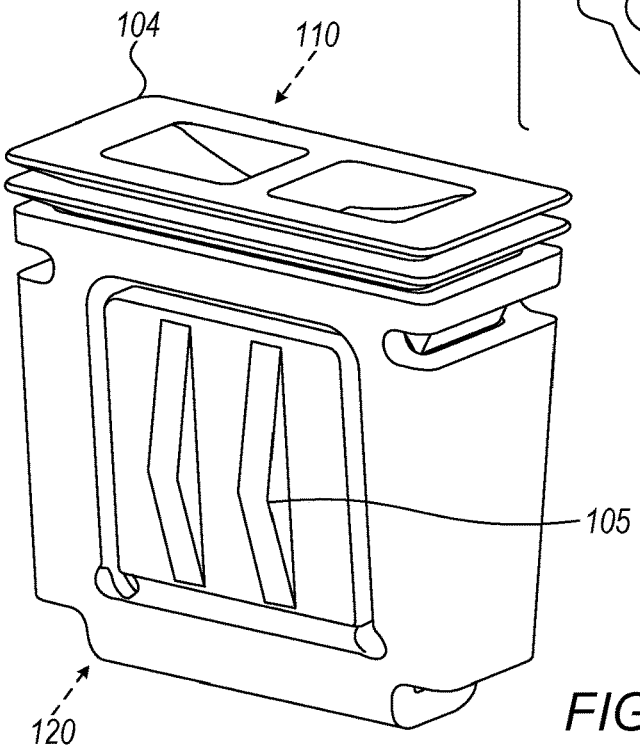
FIG. 1D shows the confining cell of FIG. 1C in a closed state, according to some embodiments of the invention.

Reference is made to FIGS. 1C and 1D, which schematically illustrate a different configuration of the cell 150 in an open state and a closed state, respectively, according to some embodiments of the invention. In the configuration of the cell 150 (shown in FIGS. 1C and 1D), the cap 104 may be removably attached to the housing 107, while the first wall 101 and the second wall 102 may be fixedly attached to the housing 107. Thus, the blister pack 10 may be inserted into the cavity 106 such that the cap 104 may be later manually attached to the housing 107. For example, the cap 104 may have one or more prongs 157 configured to attach to a corresponding aperture at the housing 107. In some embodiments, the one or more prongs 157 may be elastic and allow removable attachment of the cap 104 to the housing 107. In some embodiments, there is no need to rotate the walls in order to hold the blister pack 10 within the cell.

Figure 1E:
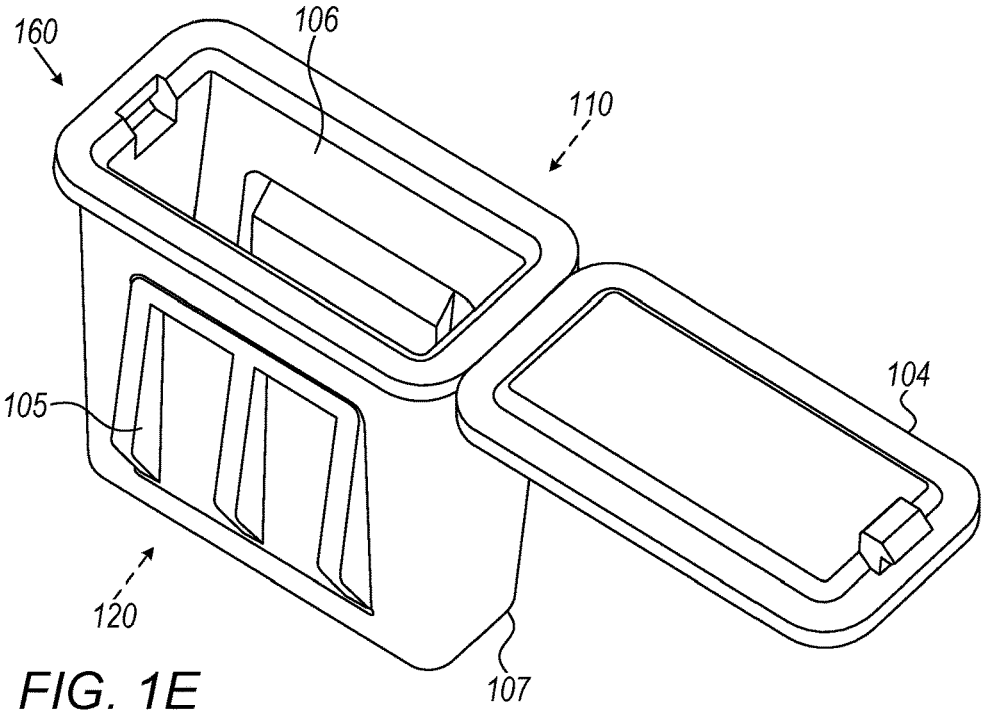
FIG. 1E shows a different configuration for a confining cell, according to some embodiments of the invention.

Reference is made to FIG. 1E, which schematically illustrates a different configuration of the cell 160, according to some embodiments of the invention. In the configuration of the cell 160 (shown in FIG. 1E), the cap 104 may be pivotally attached to the housing 107 such that the cap may be rotated to close the blister pack within the cavity 106.

Figure 1F:
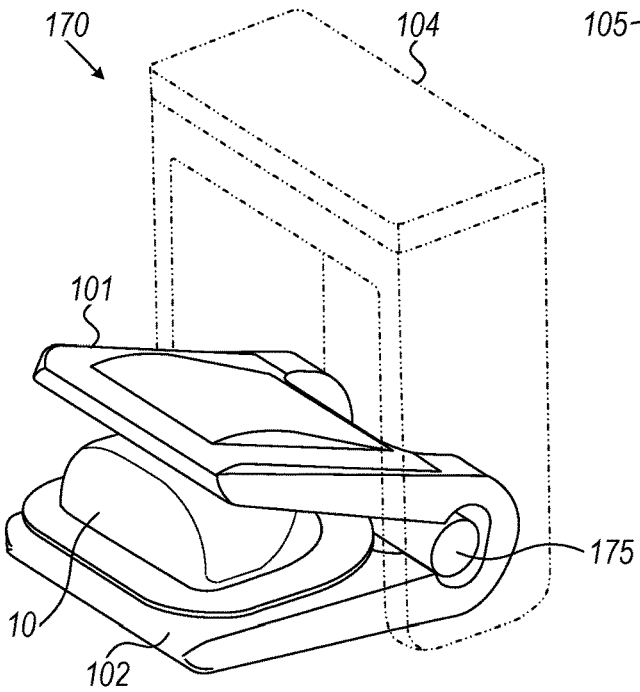
FIG. 1F shows a different configuration of a confining cell, according to some embodiments of the invention.

Reference is made to FIG. 1F, which schematically illustrates a different configuration of the cell 170, according to some embodiments of the invention. In the configuration of the cell 170 (shown in FIG. 1F), the housing 107 may be pivotally attached to the first wall 101 and the second wall 102 such that once the blister pack is inserted between the walls 101, 102, the housing may be rotated (e.g., rotated about axis 175) to keep the blister pack 10 within the housing 107. In some embodiments, if the cell 170 is inserted into a cell holder, the housing may no longer rotate.

Figure 1G:
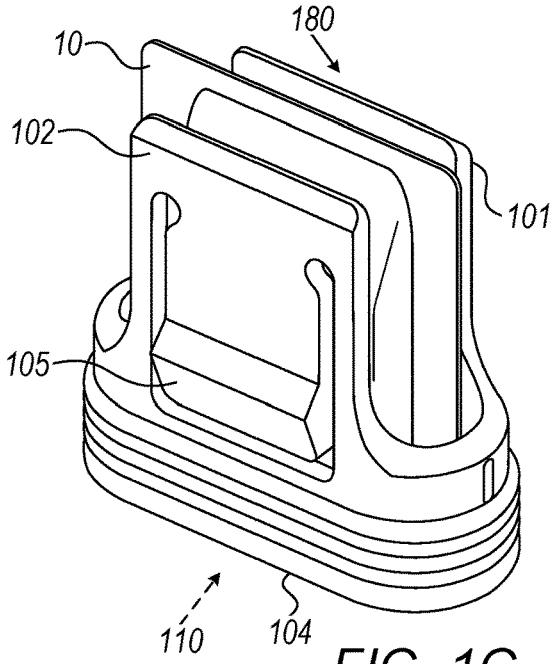
FIG. 1G shows a different configuration of a confining cell, according to some embodiments of the invention.

Reference is made to FIG. 1G, which schematically illustrates a different configuration of the cell 180, according to some embodiments of the invention. In the configuration of the cell 180 (shown in FIG. 1G), the cap 104 may be directly attached to the walls 101, 102 without the housing.

Figure 2:
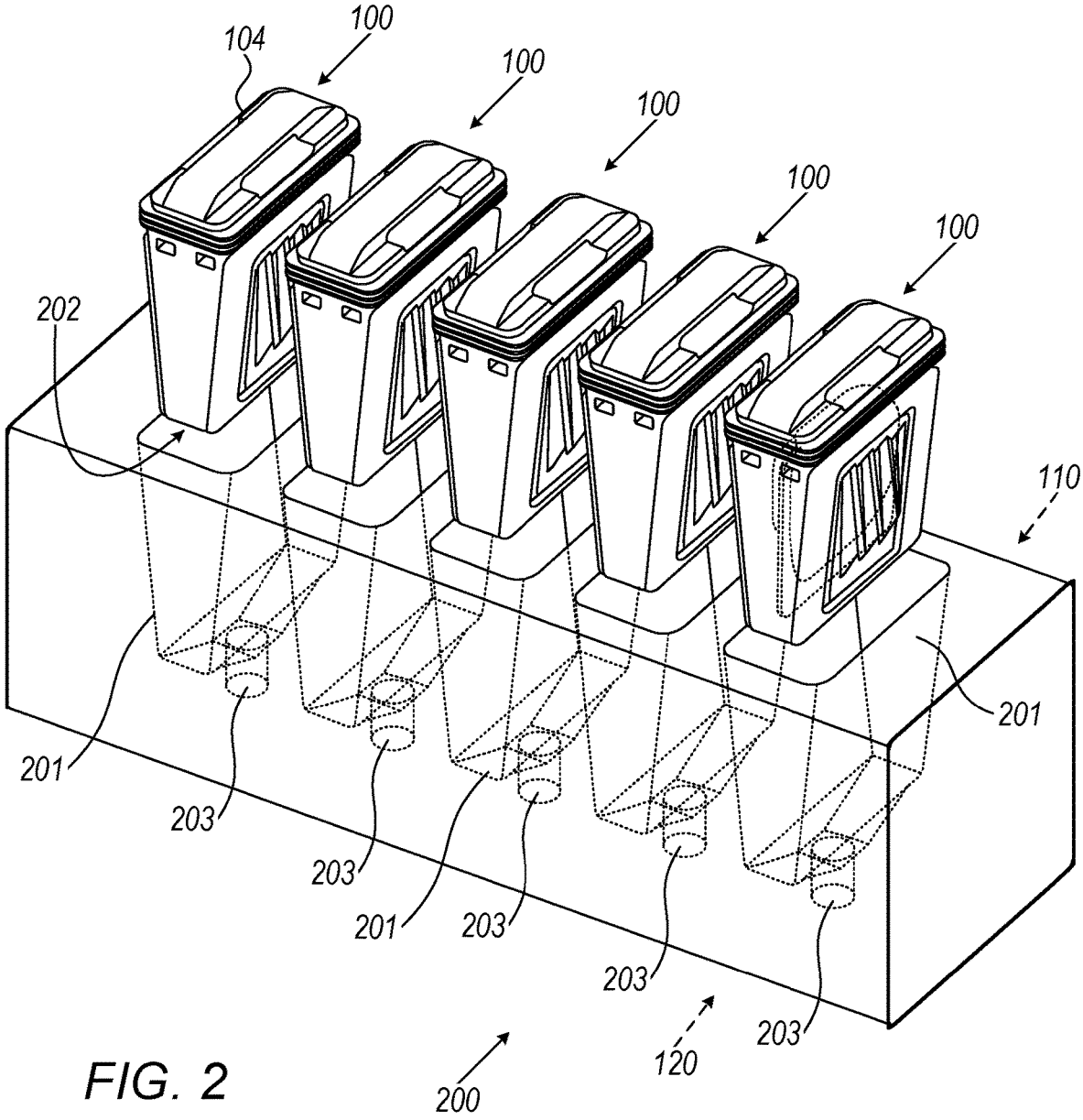
FIG. 2 shows a blister pack holder, according to some embodiments of the invention.

Reference is made to FIG. 2, which schematically illustrates a cell holder 200, according to some embodiments of the invention.

The cell holder 200 may include one or more compartments 201, with each compartment 201 configured to accommodate a single cell 100 (e.g., as shown in FIGS. 1A and 1B). In some embodiments, the cell holder 200 may include five compartments 201. It should be noted that while five compartments 201 are illustrated in FIG. 2, the cell holder 200 may include any other number of compartments 201. In some embodiments, other configurations of cells may also be used for the cell holder 200, for example the cells shown in FIGS. 1C-1G.

Each compartment 201 may have an opening 202 at the first side 110, through which the cell 100 may be inserted. In some embodiments, each compartment 201 may further include at least one fluid outlet 203 at the second side 120, through which fluid may flow towards the second side 120. For example, flow through a dedicated channel towards a dedicated diagnosis chip.

In some embodiments, insertion of a cell 100 into the opening 202 of the compartment 201 may close that opening 202 by the cap 104 of that cell 100.

According to some embodiments, insertion of a cell 100 into the opening 202 of the compartment 201 may cause the blister pack 10 within that cell 100 to burst such that fluid extracted from the blister pack 10 may flow through the fluid outlet 203. For example, the shape of the compartment 201 may sloped such that engagement of the one or more protrusions of the cell with the compartment 201 may cause the one or more protrusions to be pushed inward and thereby apply a force onto the blister pack accommodated within the cell until the blister pack 10 bursts thus allowing the fluid to flow towards the outlet 203.

In some embodiments, at least one confining cell 100 may provided, which is configured to receive a blister pack 10 and when the confining cell 100 is pushed into the compartment 201 the confining cell 100 exerts pressure on the blister pack that causes the blister pack 10 to burst. For example, the cell 100 may be inserted into the compartment 201 such that when the cell 100 is fully inserted the interior walls of the compartment 201 may apply a force on the elastic material of the cell 100 and thereby push the blister pack 10 within that cell 10 in order to cause the blister pack 10 to burst.

In some embodiments, the shape of at least one compartment 201 may correspond to the shape of the cell 100, such that insertion (e.g., manual or automated insertion) of the cell 100 into the at least one compartment 201 may apply pressure onto that cell 100 to cause the blister pack 10 within the cell 10 to burst.

In some embodiments, the shape of at least one compartment 201 may be narrowing in shape from the opening 202 at the first side 110 and towards the second side 120. The narrowing shape of the at least one compartment 201 may correspond to a narrowing shape of at least one cell 100.

In some embodiments, at least one compartment 201 may be configured to hold the cell 100 in a vacuum. For example, the internal walls of the compartment 201 may tightly abut the cell 100 such that a vacuum may be formed within the compartment 201. In some embodiments, the cell holder 200 may be connected to a pneumatic system such that vacuum may be created via air suction through the fluid outlets 203.

Figure 3:
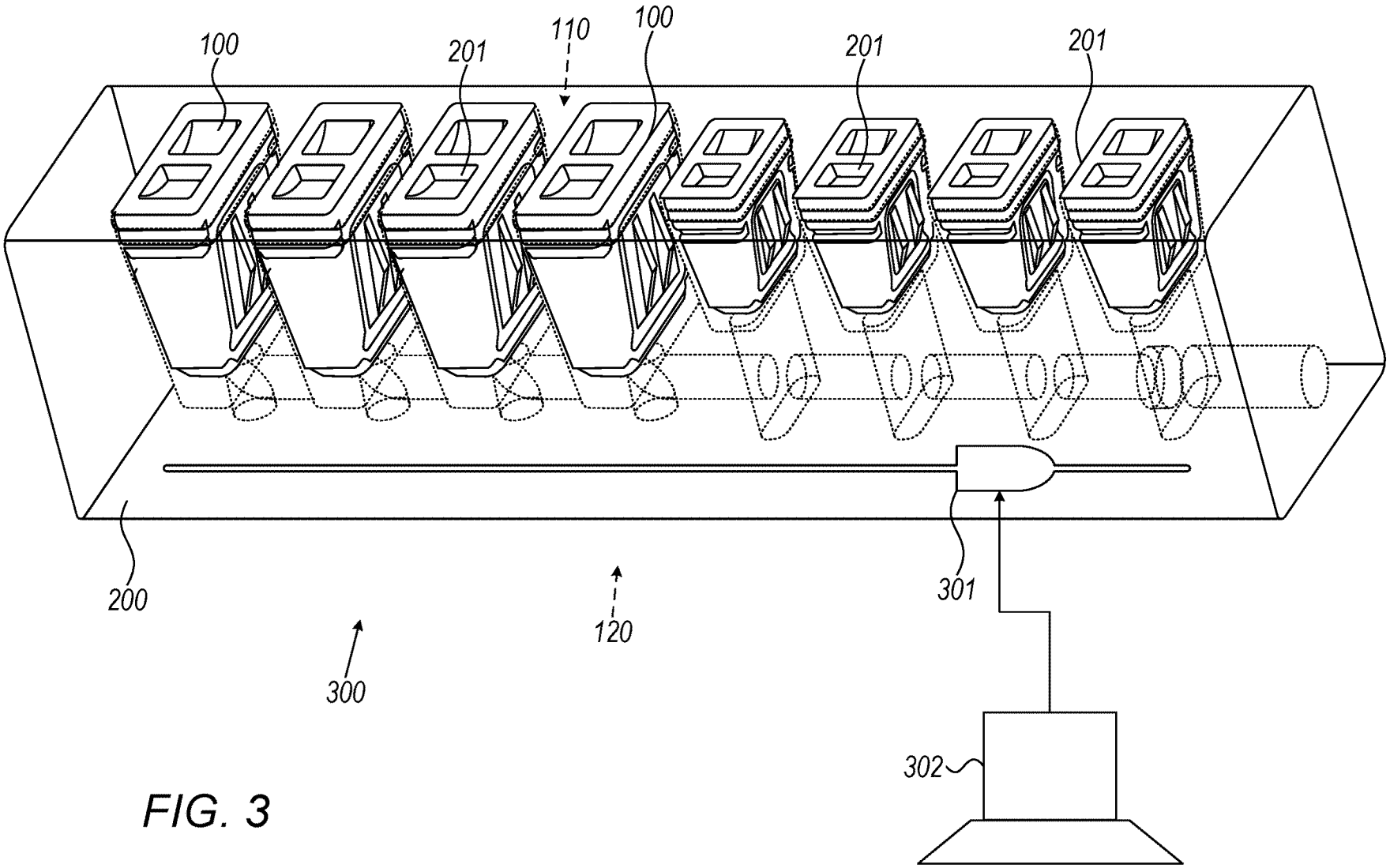
FIG. 3 shows a blister pack holder, according to some embodiments of the invention.

Reference is made to FIG. 3, which schematically illustrates a blister pack holding system 300, according to some embodiments of the invention.

The blister pack holding system 300 may include the cell holder 200 holding at least one cell 100. In some embodiments, the cell holder 200 may further include at least one analysis chip 301 attachable to the fluid outlet 203 of at least one compartment 201. The at least one analysis chip 301 may be configured to perform analysis on fluid extracted from a blister pack 10 in that at least one compartment 201.

In some embodiments, the at least one analysis chip 301 may be connected to at least one processor 302 configured to perform further analysis and/or processing on data received from the at least one analysis chip 301.

For example, the blister pack holding system 300 may include the cell holder 200 with five compartments 201, where each fluid outlet 203 of each compartment 201 may be connected to the at least one analysis chip 301.

The at least one analysis chip 301 may perform a single test on multiple samples (e.g., of different patients), and/or perform different test on multiple samples (e.g., of the same patient).

Thus, a portable blister pack holding system 300 may be provided for analyzing with the reagent within the blister packs. In contrast to other methods where the liquid in each blister pack is analyzed separately.

Once at least one cell 100, accommodating a blister pack 10, is inserted into a compartment 201, the force applied by the inner walls of the compartment 201 may squeeze or push the walls 101, 102 of that cell 100 so as to burst the blister pack 10 accommodated within.

For instance, insertion of a cell 100 may cause the inner walls of the compartment 201 to push at least one protrusion 105 (e.g., shown in FIG. 1B) of the cell 100 inward and accordingly burst the blister pack 10 accommodated within.

According to some embodiments, the shape of the compartments 201 may be configured to hold all cells 100 without bursting the blister packs 10 therein, until additional force is applied on the cells 100 to be pushed further into the compartments 201.

For example, each compartment 201 may hold a cell 100 such that the cell 100 is not fully inserted into the corresponding compartment 201 due to the shape of the compartments 201 with the inner walls abutting the cell 100.

In some embodiments, the inner walls of each compartment 201 may abut the at least one protrusion 105 of the cell 100 and thereby hold the cell 100 without bursting the blister pack 10 therein. Once additional force is applied to further push the cell 100 into the compartment 201, the inner walls of the compartment 201 may further push the cell 10 to cause the blister pack 10, accommodated therein, to burst.

In some embodiments, the portable blister pack holding system 300 may further include a plate to simultaneously push all cells 100 into their corresponding compartments 201 until the blister packs 10 therein bursts. For example, if at least one cell 100 is not fully inserted into the compartment 201, a user may apply the plate to ensure that all cells are fully pushed into their compartments 201, thereby ensuring to burst all blister packs 10.

Once all cells 100 are fully inserted into their corresponding compartments 201, the blister packs 10 within these cells 201 are burst, and the fluid may flow towards the fluid outlet 203 at the second side 120. The extracted fluid may be accordingly analyzed by the at least one analysis chip 301 and/or by the at least one processor 302 so as to perform further analysis and/or processing on data received from the at least one analysis chip 301. For example, a blister pack 10 filled with a reagent may be squeezed to release the fluid onto the at least one analysis chip 301 thereby allowing diagnosis of the reagent with at least one sample of a patient.

According to some embodiments, a plurality of blister pack holding systems 300 may be used to analyze a plurality of samples. Accordingly, at least one cell holder 200 may be inserted into a dedicated cell matrix for analysis of the gathered fluids. Thus, a plurality of cells 100 in a plurality of cell holder 200 may be used to simultaneously analyze the fluids from the blister packs 10 accommodated therein.

According to some embodiments, the process of inserting the fluid into the blister pack may include additional steps in order to enhance the fluid extraction from the blister pack. A needle may be inserted into an opening in the blister pack 10, and a fluid may be injected through the needle into the blister pack 10.

Once the needle is removed, the edges of the blister pack 10 may be welded with a first layer. Then, at least a portion of the blister pack 10 may be welded again with a second layer, such that the blister pack 10 may only burst from a portion without the second layer. Thus, the fluid may only burst from a desired portion in the blister pack 10, for instance from a portion configured to allow flow directly towards the outlet of the compartment 201.

Figure 4:
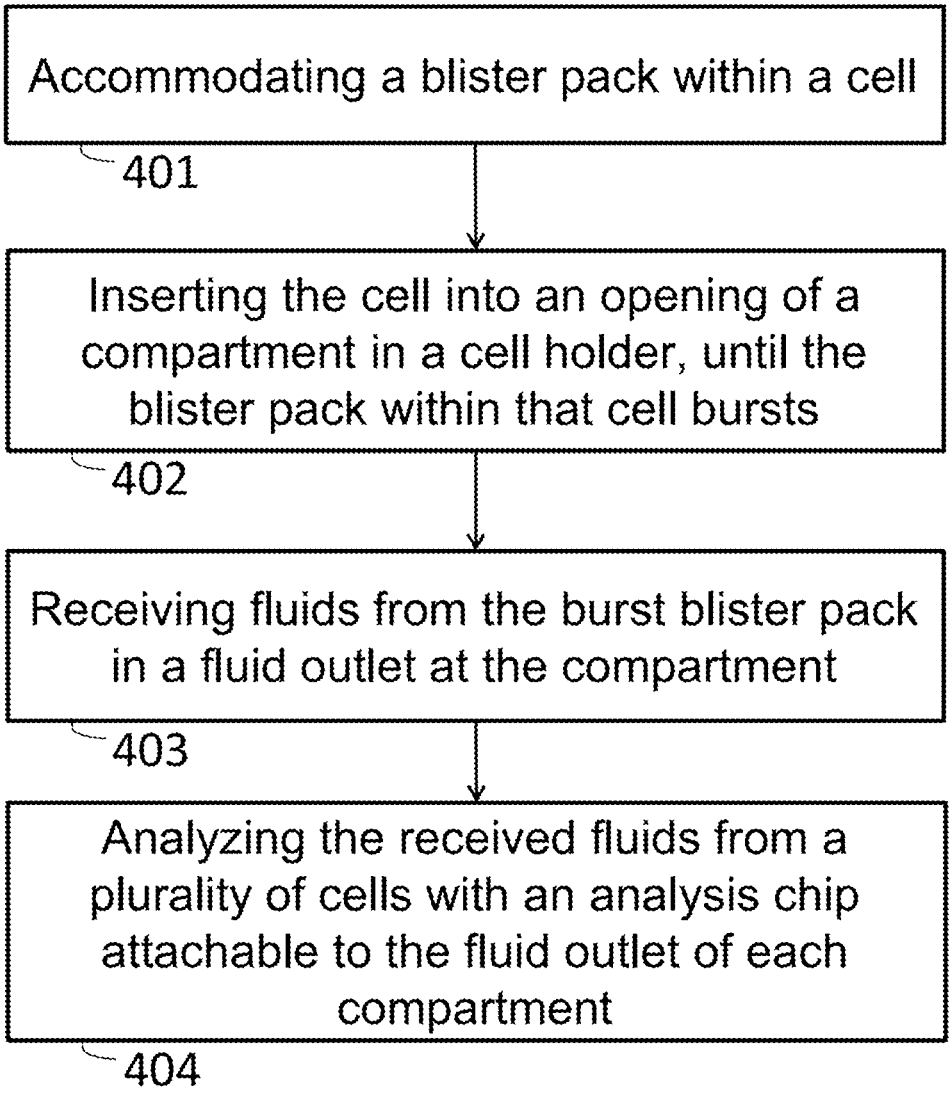
FIG. 4 shows a flowchart of a method of holding at least one blister pack filled with a fluid, according to some embodiments of the invention.

Reference is made to FIG. 4, which shows a flowchart of a method of holding at least one blister pack filled with a fluid, according to some embodiments of the invention.

In Step 401, a blister pack may be accommodated within a cell. In Step 402, the cell may be inserted into an opening of a compartment in a cell holder, until the blister pack within that cell bursts.

For example, insertion of the cell into the compartment may cause the inner walls of the compartment to push at least one protrusion of the cell inwardly until the blister pack within that cell bursts.

In Step 403, fluids from the burst blister pack may be received in a fluid outlet at the compartment. In Step 404, the received fluids from a plurality of cells may be analyzed with an analysis chip attachable to the fluid outlet of each compartment.

Figure 5A:
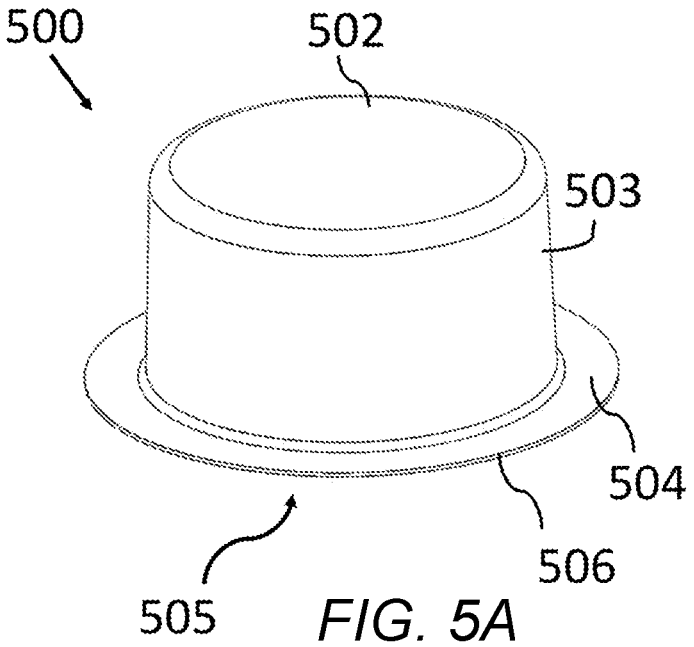
FIG. 5A shows a blister pack with a brim, according to some embodiments of the invention.

Reference is made to FIG. 5A, which schematically illustrates a perspective view of a blister pack 500 with a brim, according to some embodiments of the invention. The blister pack 500 may include a containing body 503, for example in the shape of a cup or a hat. The containing body 503 may be made of, for example, plastic or aluminum, and may be produced, for example, in vacuum forming or pressure forming to acquire its shape and volume. According to some embodiments, the containing body 503 may be in the shape of a cylinder, cap, other vessel-shape, etc.

The containing body 503 defines an internal volume in which fluid may be dispensed, through an opening 505. The blister pack may be designed to hold, within the containing body 503 fluid comprising a reagent, reactant, solvent, catalyst, substrate, and/or any other substance that is used for reacting or for bringing in contact with a sample to be tested (e.g., blood, saliva, urine, chemical substances, biological substances, in liquid, powder, dried, aerosols or other form).

Opening 505 may be defined and surrounded by brim 504. A lid 506 may be provided to seal the content of the containing body 503, for example an aluminum foil or plastic film, that may be welded to the brim 504.

In some embodiments of the invention, a bundle of blister packs may be produced as a single unit, for example by vacuum forming or pressure forming applied on a sheet of plastic or aluminum to define a plurality of containing bodies, which are then filled and sealed off, for example, by a lid welded to the flat brim surrounding the openings of the containing bodies.

A typical vacuum forming or pressure forming includes applying vacuum and or pressure on a sheet of plastic to form predetermined volumetric shapes sunken in the plastic sheet. In this manner a sheet with a plurality of blister containing bodies may be produced.

After the containing bodies are formed and filled (e.g., with fluid), a lid layer, e.g. aluminum foil or plastic film may be laid over the sheet and welded over the containing bodies thereby sealingly covering their content.

Figure 5B:
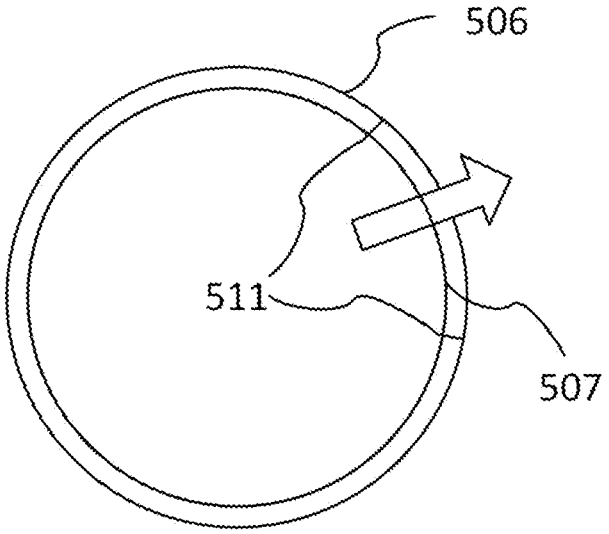
FIG. 5B shows a lid of a blister pack with a weakened burstable welding line, according to some embodiments of the invention.

FIG. 5B illustrates a lid of a blister pack with a weakened burstable welding line, according to some embodiments of the invention According to some embodiments of the present invention, a lid 506 of a blister pack may be designed to burst at a weakened welding line 507, which is produced during the welding process of the lid over the opening of the containing body of the blister pack. Some of the welding line, for example, one or more sectors of the peripheral welding line, e.g., sector 511, or lines that define the lid, and hold it over the blister pack opening, may be weakened so that when pressure is applied onto the blister pack the weakened welding line gives in causing the lid to disengage from the blister body along the weakened line and allowing the content of the blister pack to spill out through the burst opening.

In some embodiments of the present invention, it may be desirable to select other area or areas of the blister lid for controlled bursting, so as to ensure that the fluid in the blister pack is dispensed fully or nearly in full and gets to its target rather than be trapped in air pockets or wrinkles in the lid or the containing body resulting from the pressure applied on the blister pack when it is burst.

According to some embodiments of the invention, the lid of the blister pack is provided with a weakening pattern that is designed to yield and burst when subjected to a pressure. The location of the weakening pattern is selected so as to allow fully or nearly fully dispensing the fluid initially contained in the blister pack and directing the dispensed fluid to the desired direction.

According to some embodiments of the invention, a method for producing a blister pack, the method may include providing a blister pack comprising: a containing body with an opening; and a lid sealed over the opening, and producing a weakening pattern on the lid, wherein a width of the lid at the weakening pattern is thinner that a width of the lid elsewhere, and wherein the lid is configured to burst at the weakening pattern when the blister pack is subjected to pressure, so as to allow liquid content inside the containing body to be discharged out of the blister pack through the burst weakening pattern.

According to some embodiments of the present invention, the weakening pattern comprises at least one weakened weld line, where the lid is welded to the brim of the containing body of the blister pack.

According to some embodiments of the invention, a weakening pattern may be produced on the lid, in one or more selected areas, over the opening of the blister containing body covered by the lid, away from an area of the lid which is in contact with the containing body and not at welded lines or welded areas.

Figure 5C:
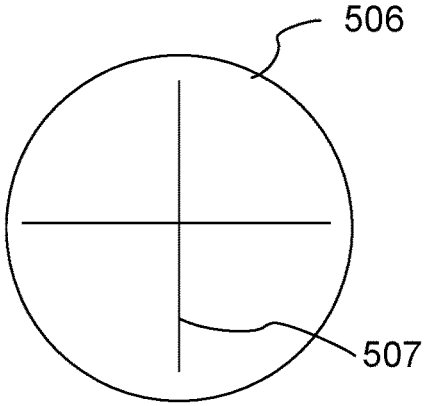
FIG. 5C shows a lid of a blister pack with a weakened burstable pattern, according to some embodiments of the invention, in the form of a cross.

For example, a weakening pattern may be produced by scratching, etching, inscribing, engraving, impressing etc., a pattern, which effectively reduces the thickness of the lid where it is desired to affect the bursting of the lid. FIG. 5C illustrates a lid 506 of a blister pack with a weakening burstable pattern 507, according to some embodiments of the invention, in the form of a cross.

Figure 5D:
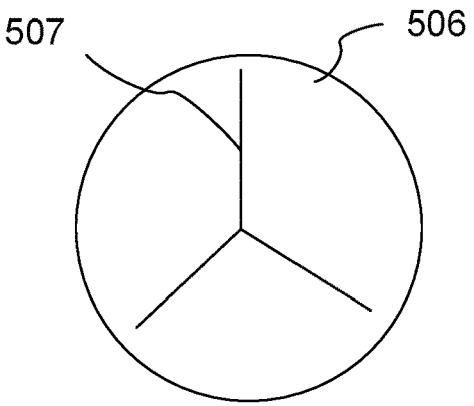
FIG. 5D shows a lid of a blister pack with a weakened burstable pattern, according to some embodiments of the invention, in a Y form.

FIG. 5D illustrates a lid 506 of a blister pack with a weakening burstable pattern 507, according to some embodiments of the invention, in a Y form.

Figure 5E:
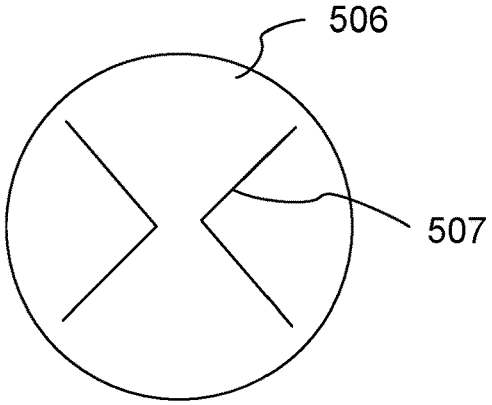
FIG. 5E shows a lid of a blister pack with a weakened burstable pattern, according to some embodiments of the invention, in a two-part form.

FIG. 5E illustrates a lid 506 of a blister pack with a weakening burstable pattern 507, according to some embodiments of the invention, in a two-part form.

The weakening patterns shown in FIGS. 5B-5E extend across parts of the lid that are located away from the welding area of the lid, and in that effectively localize the burst area or areas to a centered portion of the lid over the opening of the blister. However, these weakening patterns may require some registration effort when welding the lid foil over the blister containing body or bodies to ensure that the weakening pattern is correctly located over the opening of the blister pack.

Figure 5F:
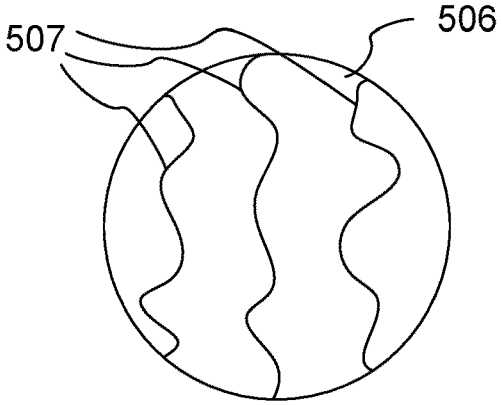
FIG. 5F shows a lid of a blister pack with a weakened burstable pattern, according to some embodiments of the invention, in a continuous form.

FIG. 5F illustrates a lid 506 of a blister pack with a weakening burstable pattern 507, according to some embodiments of the invention, in a continuous form. A continuous weakening pattern makes the task or registration of a lid foil over a sheet of formed blister containing bodies much simpler, as the continuous pattern needs only be aligned in one dimension—the direction or axis along which the blister bodies are located. The continuous weakening pattern may include one or more weakening pattern lines extending across the lid.

Figure 5G:
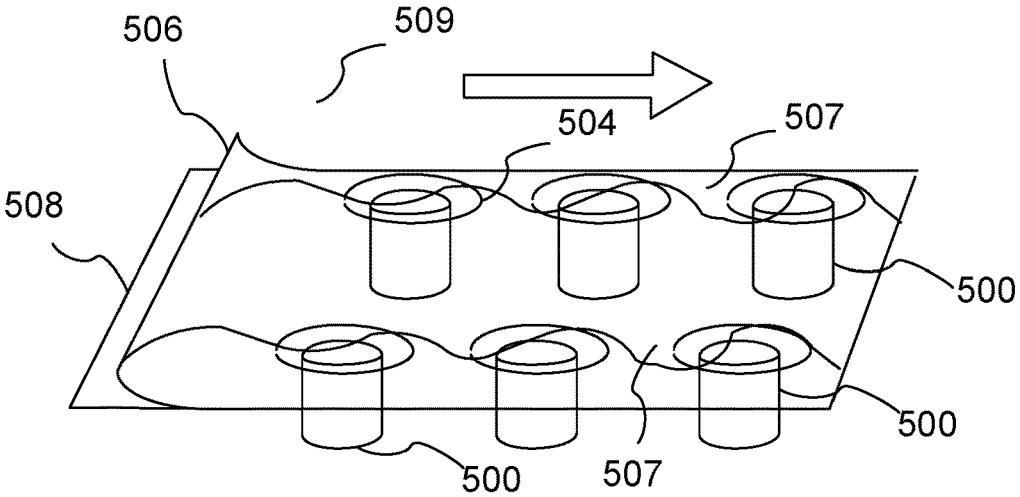
FIG. 5G shows a process of welding a lid foil over a plurality of blister pack containing bodies, according to some embodiments of the present invention.

FIG. 5G illustrates a process of welding a lid foil over a plurality of blister pack containing bodies, according to some embodiments of the present invention.

A sheet 508 of formed blisters 500, after filling the blister containing bodies with fluid, is advanced in the direction indicated by the arrow and a lid foil 506, with imprinted weakening pattern is laid onto the sheet and welded (a welding press is not shown in this figure for brevity). Sheet 508 and lid 506 in this figure appear transparent to allow a clearer view of details, however in other embodiments the sheet and lid may be non-transparent.

The weakening patterns 507 extends continuously across the lid foil 506 and is designed to cross over the openings of the blisters. Registering the lid foil over the blister sheet 508 only requires one-dimensional alignment, because the weakening pattern is continuous.

The blister packs 500 may then be individually separated from the sheet, or a group of blister packs may remain held together on a single sheet.

Figure 5H:
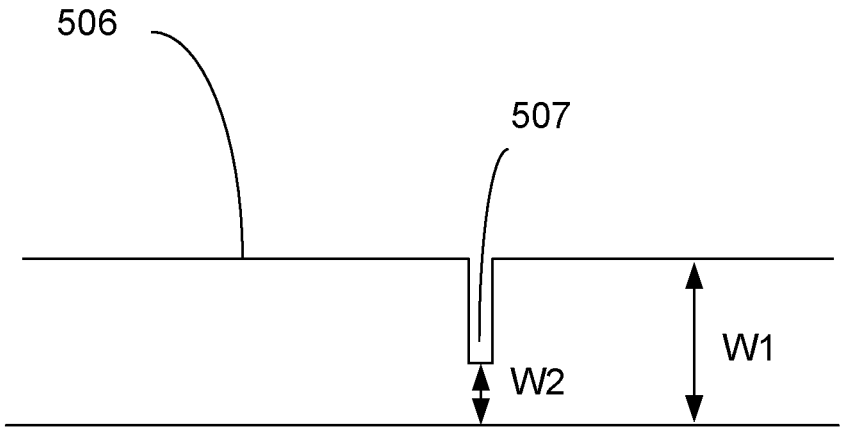
FIG. 5H is a cross section of a lid of a blister pack, according to some embodiments of the present invention.

FIG. 5H is a cross section of a lid of a blister pack, according to some embodiments of the present invention. Lid 506 has a thickness W1. In some embodiments of the present invention, a typical general thickness of the lid 506, for example aluminum lid, may be in the range of 50 to 200 microns, and the thickness of the lid at the weakening pattern 507, denoted W2, may be designed to be reduced to some 30-70% of the general thickness of the lid W1 elsewhere, rendering the weakening pattern prone to bursting when the pressure within the blister pack exceeds a threshold bursting pressure.

For example, an embossing machine may be used to emboss the weakening burstable pattern on the lid layer. The imprinted pattern defines a weakening pattern characterized in that the lid layer thickness is reduced at the imprinted pattern position, due to the pressure applied by the imprinting head onto the lid foil or film.

Figure 5I:
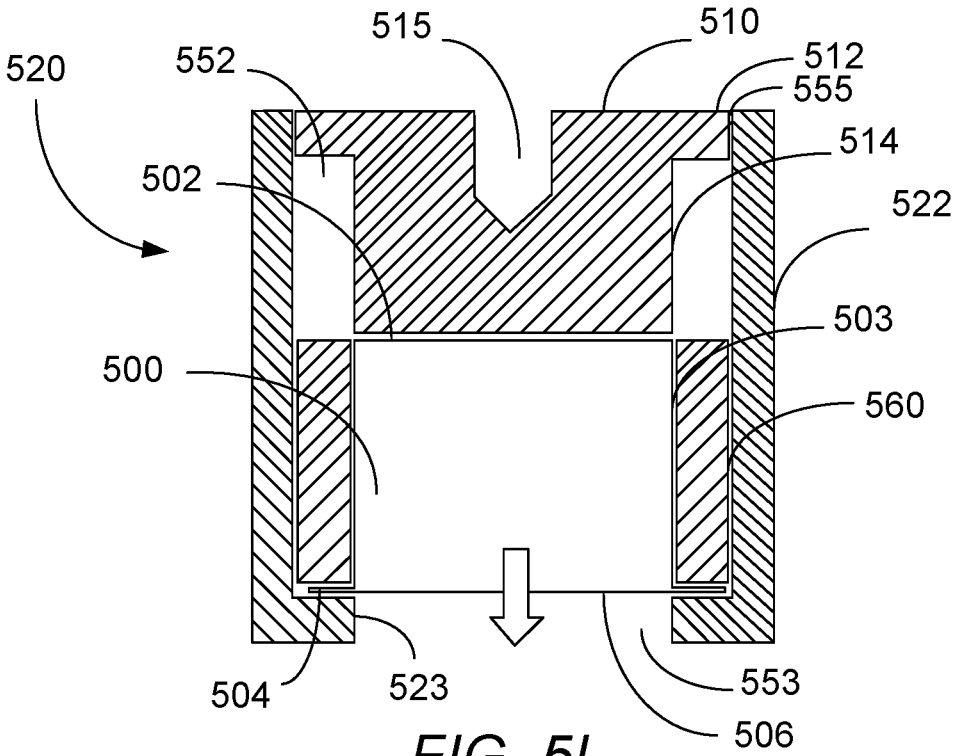
FIG. 5I is a cross section view of a single blister pack inside a bore of a blister pack holder, according to some embodiments of the present invention, the blister pack having a cylindrical form.

FIG. 5I is a cross section view of a single blister pack inside a bore of a blister pack holder, according to some embodiments of the present invention, the blister pack having a cylindrical form.

Block 522 of blister pack holder 520 may include a cylindrical bore 552 having a first top opening 555 at a first end of the bore and bottom support 523 (e.g., a circumferential flange) defining a second bottom opening 553 at a second end of the bore which is opposite the first end. The bottom opening 553, in some embodiments of the invention, is narrower than the internal diameter of the bore, so as to form a support for the brim 504 of blister pack 500 when inserted in the bore. Top and bottom opening are suitable when relying on gravity when dispensing the content of the blister pack, however other orientations may apply, for example when the blister holder is linked to a pneumatic system in which the content of the blister pack/s is discharged. A sleeve 560 may be provided which is configured to engulf and accommodate the containing body of the blister pack and fill the internal void of the bore so as to define a tight space for accommodating the containing body of the blister pack. Piston 510 may be provided, having a top portion 512 in a cylindrical form configured to fit the top opening 555 of the bore, and a narrower bottom portion 514 in the form of a cylinder configured to fit into sleeve 560. The sleeve in the embodiment shown in FIG. 5I has a cylindrical form—a cylindrical outer surface facing the bore wall and a cylindrical inner surface facing the containing body of the blister pack. Piston 510 may include cavity 515, e.g., a concentric cavity with respect to the piston, into which a plunger may be inserted to compress the piston into the bore, applying pressure to the top 512 of the blister pack 500, to cause the blister to collapse and to burst lid 506 at the weakening pattern, forcing the liquid content of the blister through the bottom opening 553 (in the direction indicated by the arrow). In some embodiments of the present invention, the length of the bottom portion 514 of the piston is designed be substantially equal to the length of sleeve 560.

Figure 5J:
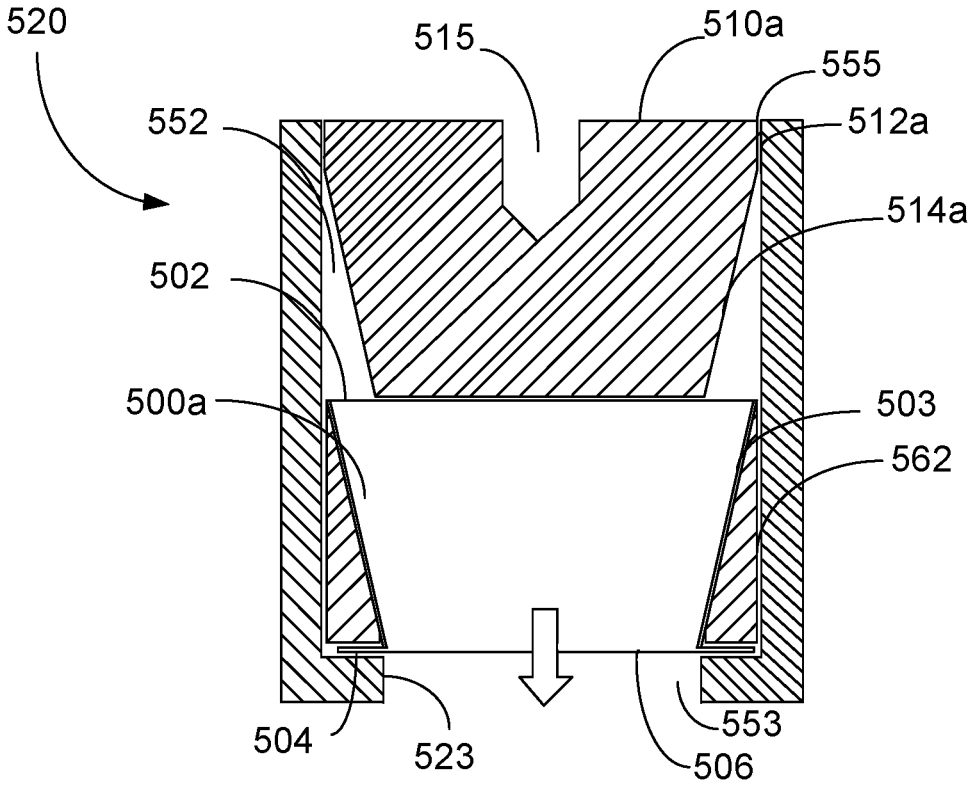
FIG. 5J is a cross section view of a single blister pack inside a bore of a blister pack holder, according to some embodiments of the present invention, the blister pack having a truncated cone form.

FIG. 5J is a cross section view of a single blister pack inside a bore of a blister pack holder, according to some embodiments of the present invention, the blister pack 500*a* having a truncated cone form. In this embodiment the blister pack has a body in the form of a truncated cone, having a top diameter which is broader than the bottom diameter. A matching sleeve 562 which has an outer cylindrical surface and an inner tapered space configured to fit around the blister pack body. This form allows increased volume of the blister content with respect to a cylindrical blister having the same height (see FIG. 5I). The sleeve may be provided during the manufacturing of the blister pack, for example by placing the sleeve adjacent to the sheet undergoing vacuum forming, so that the blister pack body is formed inside the sleeve. The sleeve may be rigid (e.g., made of material such as plastic, metal, or other rigid material) to hold against the body of the blister when the blister is formed, e.g., in vacuum or pressure forming. The rigidity of the sleeve may be a contributing factor in expulsion of the blister content (e.g., liquid) when the piston is used to press and squeeze the blister. Piston 510*a* is modified with respect to the piston shown in FIG. 5I, in order to properly expel the content of the blister, when pressed into the bore. The top portion 512*a* of the piston is configured to fit the top opening 555 of the bore, and the bottom portion 514*a* of the piston is tapered, in the form of a truncated cone that substantially tightly fits the internal space within the sleeve, so as to ensure maximal expulsion of the content of the blister when piston pressure is applied on the blister. When piston 510*a* is compressed into the bore, it applies pressure onto the blister pack eventually causing the blister pack to collapse, bursting the lid 506 at the weakening pattern and discharging its content through bottom opening 553, in the direction indicated by the arrow.

The piston may be mechanically or electronically operated, manually or automatically, for example by finger depression, by an electrical motor and transmission transferring displacement of the motor shaft to a linear motion of the piston into the bore of the blister pack holder, etc., or pneumatically (e.g., air pressure). In some other embodiments, other translation mechanism, e.g., magnetic mechanism, pneumatic mechanism, or other arrangement may be employed to actuate the piston.

Figure 5K:
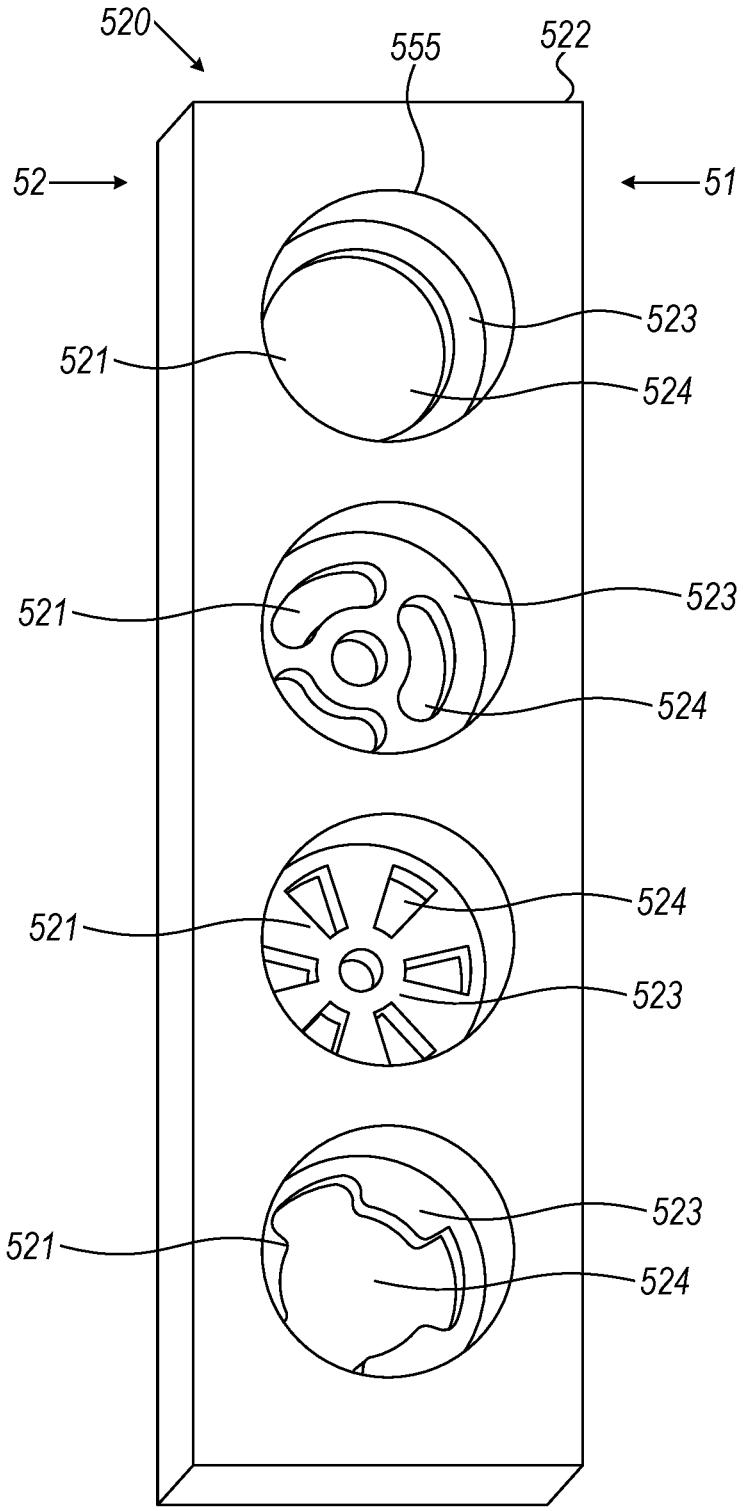
FIG. 5K shows a blister pack holder 520, according to some embodiments, with a plurality of bores, and various blister pack supports.

FIG. 5K shows a blister pack holder 520, according to some embodiments, with a plurality of bores, and various blister pack supports. The blister pack holder 520 may be configured to hold a blister pack 500 in one or more bores 521.

According to some embodiments, the blister pack holder 520 may comprise a block 522 with one or more bores 521 having a cylindrical form and extending through the block. Each bore has a top opening and bottom opening, and is configured to accommodate a blister pack 500. a blister pack 500 may be inserted into a bore 521 from the top opening 555 and placed near the bottom opening over the bottom support. The bottom opening of each bore 521 at the bottom side 52 is designed to allow fluid accommodated within the blister packs 500 to be dispensed after bursting of the blister pack lid.

In some embodiments, the blister pack holder 520 may include a perforated flange 523, at the bottom opening of each bore 521, configured to support a blister pack 500 inserted into that bore 521. The perforated flange 523 may include one or more voids 524 configured to allow passage of fluid from the blister pack 500 after bursting of the lid. According to some embodiments, the area of the at least one void 524 in each bore 521 may be smaller than the area of the opening of the containing body of the blister pack that is covered by lid 506.

It should be noted that the perforated flange 523 may have various shapes and/or sizes, and different number of openings 524, for instance as illustrated in FIG. 5J and/or have different shapes. The openings and their shapes may correspond to the shape and orientation of the weakening pattern of the lid.

Figure 6A:
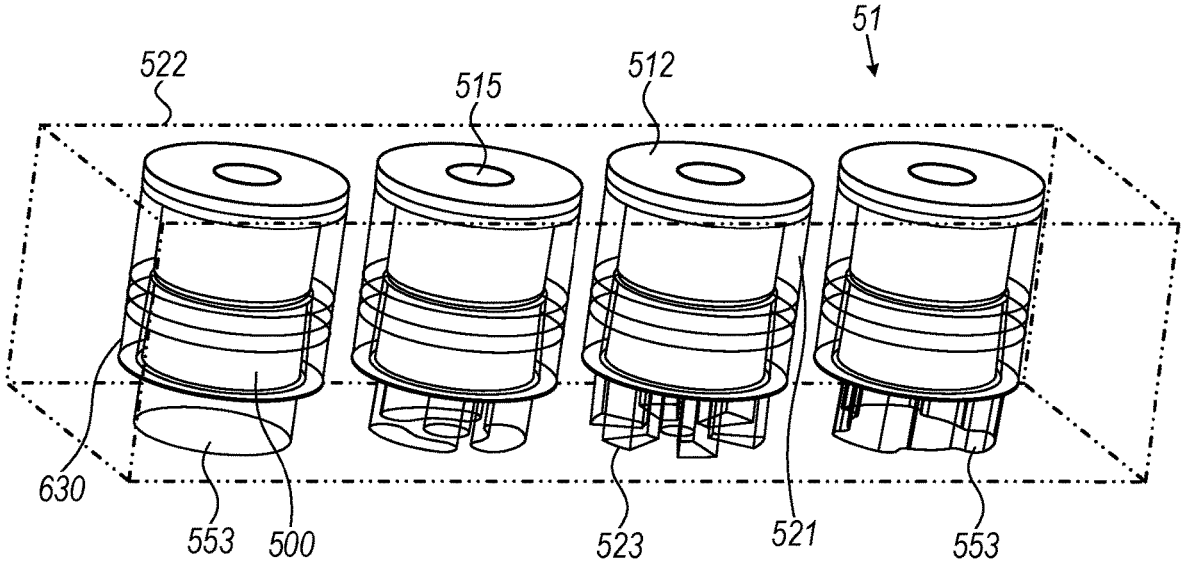
FIG. 6A shows a perspective view of a blister pack holder accommodating several blister packs, according to some embodiments of the invention.

FIG. 6A shows a perspective view of a blister pack holder accommodating blister packs, according to some embodiments of the invention.

Figure 6B:
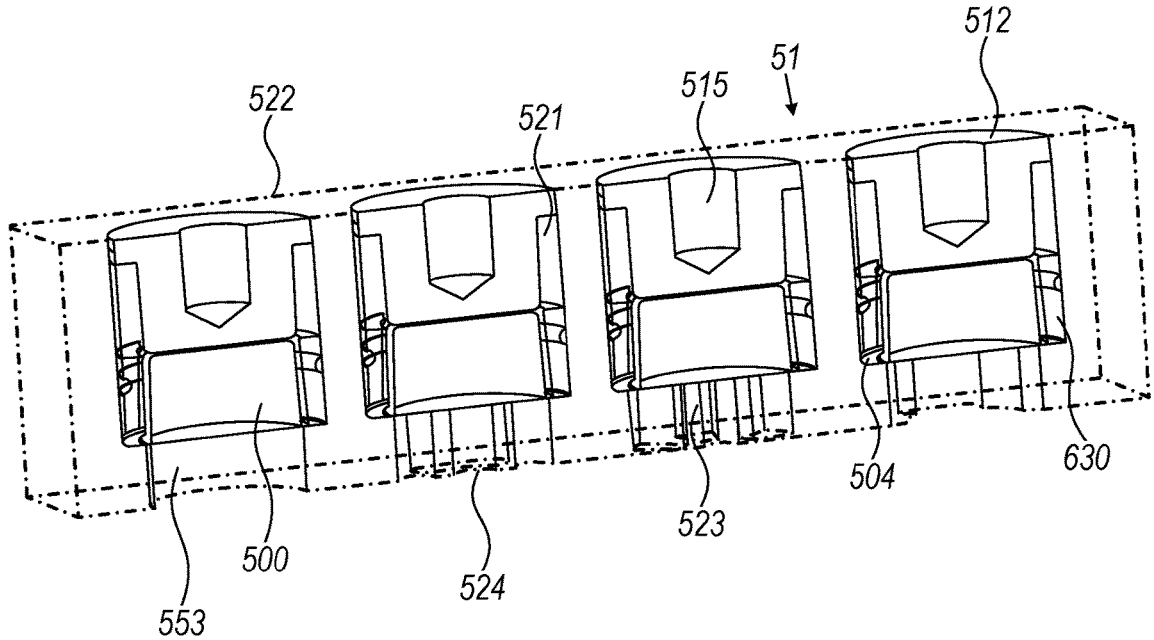
FIG. 6B shows a cross-sectional view of the blister pack holder shown in FIG. 6A.

FIG. 6B shows a cross-sectional view of a blister pack holder accommodating blister packs, according to some embodiments of the invention.

Block 522 of the blister pack holder appear transparent to allow viewing details inside.

In some embodiments, the blister pack holder 520 may include at least one bottom opening 553 at the bottom of each bore 521. The fluid filled blister pack 500 may be inserted into a corresponding bore 521, manually or automatically. Piston 510 may be placed over the blister pack following the insertion of blister pack 500 such that the piston 510 may engage the blister pack 500 and apply pressure to cause bursting of the lid of the blister pack and dispensing of the fluid through bottom opening 553.

In some embodiments, when piston 510 is depressed over the adjacent blister pack 500 in bore 521 towards the corresponding bottom opening 553, the pressure within the containing body of the blister pack increases and eventually, the lid 506 bursts, allowing the fluid content of the blister pack to be discharged through the lid 506 of the blister pack 500 and out of bottom opening 553.

Figure 7:
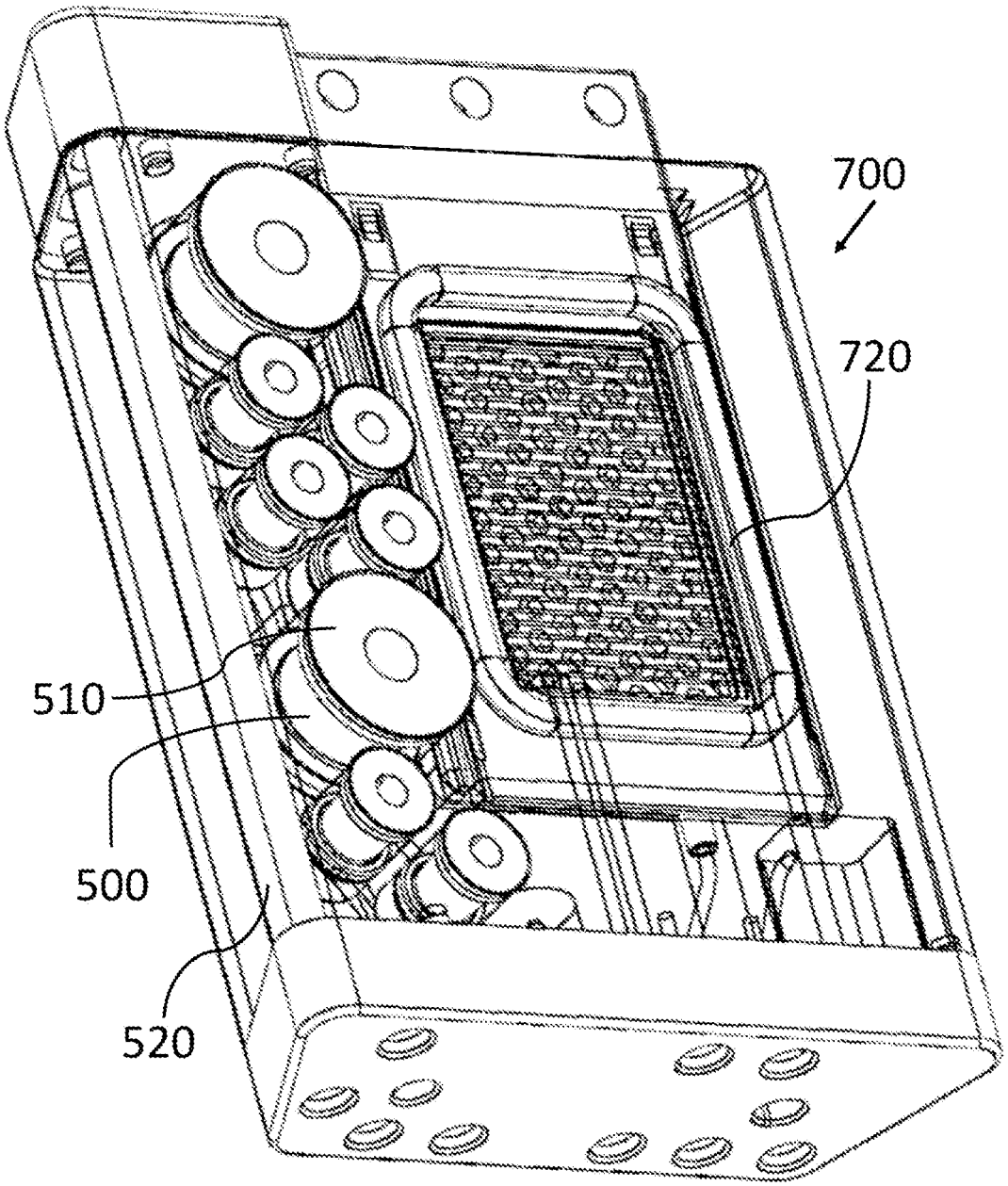
FIG. 7 shows a blister pack holding system, according to some embodiments of the invention.

FIG. 7 shows a blister pack holding system 700, according to some embodiments of the invention. The blister pack holding system 700 may include the blister pack holder 520 embedded therein with one or a plurality of bores 521 to accommodate blister packs 500.

It should be noted that the blister pack holding system 700 may hold various blister packs of different shapes and/or sizes, for instance in order to analyze different types of fluid samples.

A blister pack holding system may be incorporated in other systems, according to some embodiments of the present invention. For example, a blister pack holder may be incorporated in a sample analysis device. A sample analysis device may include, for example, a pneumatic actuator that is connected to a plurality of pneumatic connectors, the pneumatic actuator controllable to selectively apply suction or atmospheric pressure to each pneumatic connector of the plurality of pneumatic connectors so as to cause a flow of one or more liquids within a sample holder that is connected to the pneumatic connectors, the sample holder including a plurality of liquid filled containers, such as blister packs, and a plurality of conduits for conducting a liquid from each liquid container to a substrate onto which is introduced a sample that is loaded into the sample holder; a controller that is configured to control the pneumatic actuator so as to sequentially cause one or more liquids from one or more of the liquid containers to flow to the sample in the sample holder; and an analysis module for examining the sample after contact of the sample with a plurality of dots of one or more reagents that are extruded onto the subst.

For example, a blister pack holding system may include one or a plurality of blister packs, each containing a unique reagent (e.g., reagent, reactant, catalyst, substrate, antibody, enzyme, chemical substance, biological matter, etc.) for reacting with a sample, in a sample analysis system.

While certain features of the invention have been illustrated and described herein, many modifications, substitutions, changes, and equivalents may occur to those skilled in the art. It is, therefore, to be understood that the appended claims are intended to cover all such modifications and changes as fall within the true spirit of the invention.

Various embodiments have been presented. Each of these embodiments may of course include features from other embodiments presented, and embodiments not specifically described may include various features described herein.

The invention claimed is:

1. A blister pack comprising:

a containing body with an opening; and a lid sealed over the opening and provided with a weakening pattern, wherein a width of the lid at the weakening pattern is thinner that a width of the lid elsewhere, and wherein the lid is configured to burst at the weakening pattern when the blister pack is subjected to pressure, so as to allow liquid content inside the containing body to be discharged out of the blister pack through the burst weakening pattern, further comprising a sleeve accommodating the containing body.

2. The blister pack of claim 1, wherein the sleeve has a cylindrical outer surface.

3. The blister pack of claim 2, wherein the sleeve has a cylindrical inner surface.

4. The blister pack of claim 2, wherein the sleeve has a tapered inner surface.

5. A blister pack holder comprising:

a block with one or a plurality of bores extending through the block, each bore configured to accommodate a blister pack of one or a plurality of blister packs, the blister pack comprising a containing body with an opening; and a lid sealed over the opening; and one of a plurality of pressure applicators, each of said one of a plurality of pressure applicators applying pressure when actuated on a blister pack of said one of a plurality of blister packs to cause bursting of the lid of that blister pack and dispensing of liquid from that blister pack through an opening of that bore, wherein each of said one or a plurality of bores has a cylindrical form, wherein each of said one or a plurality of bores comprises a first opening at a first end of the bore and a second opening at a second end of the bore that is opposite to the first end, and wherein the second opening of the bore comprises a supporting flange, for supporting that blister pack.

6. The blister pack holder of claim 5, wherein the supporting flange is configured to support a brim of that blister pack.

7. The blister pack holder of claim 5, wherein the supporting flange comprises a plurality of voids.

* * * * *